United States Patent [19]

Olson

[11] 4,290,577

[45] Sep. 22, 1981

[54] BLOWOUT PREVENTER RAM LOCK

[75] Inventor: Richard A. Olson, Houston, Tex.

[73] Assignee: Hydril Company, Houston, Tex.

[21] Appl. No.: 78,093

[22] Filed: Sep. 24, 1979

[51] Int. Cl.[3] ..... E21B 33/06; F15B 15/26

[52] U.S. Cl. ..... 251/1 A; 92/17; 92/24

[58] Field of Search ..... 251/1 R, 1 A; 92/32, 92/24, 27, 17

[56] References Cited

U.S. PATENT DOCUMENTS

| | | | |
|---|---|---|---|
| Re. 27,294 | 2/1972 | Fredd | 91/41 |
| 2,019,163 | 10/1935 | Slater | 92/32 |
| 2,251,269 | 8/1941 | Curtis | 92/32 |
| 3,208,357 | 9/1965 | Allen et al. | 92/27 |
| 3,242,826 | 3/1966 | Smith | 92/24 |
| 4,052,995 | 10/1977 | Ellison | 137/1 |
| 4,076,208 | 2/1978 | Olson | 251/1 A |

*Primary Examiner*—Martin P. Schwadron
*Assistant Examiner*—A. Michael Chambers
*Attorney, Agent, or Firm*—Pravel, Gambrell, Hewitt, Kirk, Kimball & Dodge

[57] ABSTRACT

A ram lock for blowout preventer rams which permits locking of the ram at multiple and adjustable positions. Automatic locking of the ram at a desired position, such as in adjustable sealing positions to compensate for ram elastomer wear, is obtained. The ram also automatically unlocks in response to opening fluid pressure acting on a cylinder liner which contains a ram carrier moving the ram.

28 Claims, 4 Drawing Figures

BLOWOUT PREVENTER RAM LOCK

FIELD OF INVENTION

The present invention relates to locks for blowout preventer rams.

DESCRIPTION OF THE PRIOR ART

In ram blowout preventers, each closure of the ram causes a certain amount of wear of the ram sealing elements which move into the borehole of the preventer for sealing contact with a pipe or other object, such as another ram. During succeeding closures of the rams, the effectiveness of the seal was reduced when the ram was locked in sealing position due to such wear.

Certain prior art blowout preventer ram locks, such as in U.S. Pat. Nos. 3,242,826 and Re 27,294, used snap rings or collets mounted with a ram piston for locking. When the piston reached a predetermined locking position defined by a groove in the ram piston cylinder, the snap ring moved into the groove to lock the ram and piston in place. However, with this structure, only one locking position of the ram, as defined by the relative position of the snap ring and groove, was obtained. Change of the locking position to compensate for sealing element wear required adjustment of the relative positions of the locking elements, requiring undesirable disassembly of the blowout preventer cylinders for such adjustment to be made.

Other blowout preventer ram locks, such as in U.S. Pat. No. 3,208,357, used a tapered locking pin which moved into locking position behind the ram piston once the ram had been moved into sealing position. However, extra hydraulic operating and control lines, separate and distinct from those for causing ram piston movement, were required, increasing the complexity of the control system for those types of ram locks.

In U.S. Pat. No. 4,052,995 assigned to the assignee of the present application, these shortcomings have been for the most part overcome. However, locking action in this patent was based on frictional engagement of locking rings in locking position. For high loads, however, this frictional engagement could be subject to slippage. In certain instances, unlocking of the frictionally engaging locking structure could cause difficulties. Also, dirt or particles in the operating fluid could cause galling of the frictionally engaging locking surfaces.

U.S. Pat. No. 4,076,208, of which applicant is inventor and which is assigned to the assignee of the present application, afforded certain improvements over the foregoing prior art. However, a separate piston was required for the sole purpose of disengaging a clutch to permit unlocking of the ram, adding several parts to the lock and requiring a system of fluid passages to port fluid for unlocking. Seals required for this fluid porting system for unlocking created several potential leak paths, the leakage of any of which could cause failure of the blowout preventer.

SUMMARY OF INVENTION

Briefly, the present application provides a new and improved ram lock for blowout preventer rams which automatically locks the ram against outward movement during inward movement of the ram to a closed position in a bore of the blowout preventer, and further locks the ram at an adjustable closed position to achieve the desired degree of sealing contact with a well pipe or like object in the bore. The ram lock of the present invention further automatically unlocks the ram and permits opening thereof in response to opening fluid pressure.

A ram carrier moves the ram through the blowout preventer to and from the desired closed position. The ram carrier moves in the preventer in response to opening and closing fluid pressures and has a threaded surface which continuously engages a similar threaded surface on a lock nut rotatably moving with respect to the ram carrier. The lock nut also includes a fixed clutch plate, having ratchet teeth, which is fixedly mounted with and moves with the lock nut. A movable clutch plate having ratchet teeth adapted to move into engagement the ratchet teeth of the fixed clutch plate is mounted with the blowout preventer. The ratchet teeth are normally urged into engagement to lock the ram carrier against outward movement.

A cylinder receives the opening and closing fluid pressures to operate against the ram piston to cause movement of the ram to and from the closed positions, respectively. A cylinder liner mounted within the cylinder responds to opening fluid pressure and disables the mechanism which normally urges the ratchet teeth into locking engagement and automatically unlocks the ram lock.

DESCRIPTION OF PREFERRED EMBODIMENT

Figure 4:
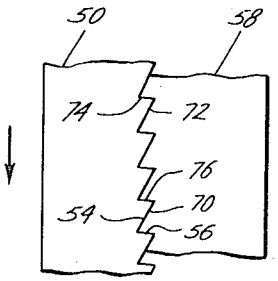
FIG. 4 is an elevation view of ratchet teeth of the lock of the present invention.

In the drawings, the letter B (FIG. 1) refers generally to a blowout preventer of this invention which is formed with a pair of rams R which are locked into place by a locking apparatus L of the present invention automatically and at adjustable closed positions for sealing contact with a well pipe or like object. The blowout preventer B is typically mounted in a stack of blowout preventers or in a string of well casing or pipe.

As is conventional, the rams R are disposed in a conventional blowout preventer body or housing 10 having a longitudinal well bore 12 formed therethrough, through which well pipe or other objects such as well tools may pass in normal operations conducted with the blowout preventer B in an open or retracted position (FIG. 1) In the open position, the rams R are mounted in conventional recesses in the body 10 adjacent the bore 12. The rams R move in response to a motive or power means M from their respective recesses into an extended or closed position in the bore 12 for sealing contact of conventional sealing elements with a well pipe, well tool or another ram. The sealing elements of the ram are conventional and are carried by the ram R. Since the sealing elements and ram blocks are conventional, they are not shown in the drawings in order to more clearly show other structure.

The rams R may be any of several types of blowout preventer rams. For example, the rams R may be of the type known as a "blind" ram for sealing against another "blind" ram of similar structure; the type wherein the sealing inner portions of the rams are shaped for sealing about a pipe or well tool in the bore, as well as with one another on each side of the pipe or well tool; or the shear-seal ram type for shearing tubing or objects in the bore 12 in conjunction with a similar shear seal ram and thereafter sealing the bore 12 of the preventer B against well pressure.

Figure 1:
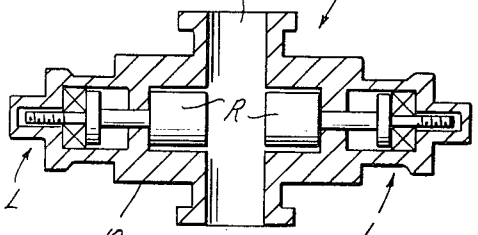
FIG. 1 is a vertical sectional view of a ram blowout preventer according to the present invention.
Figure 2:
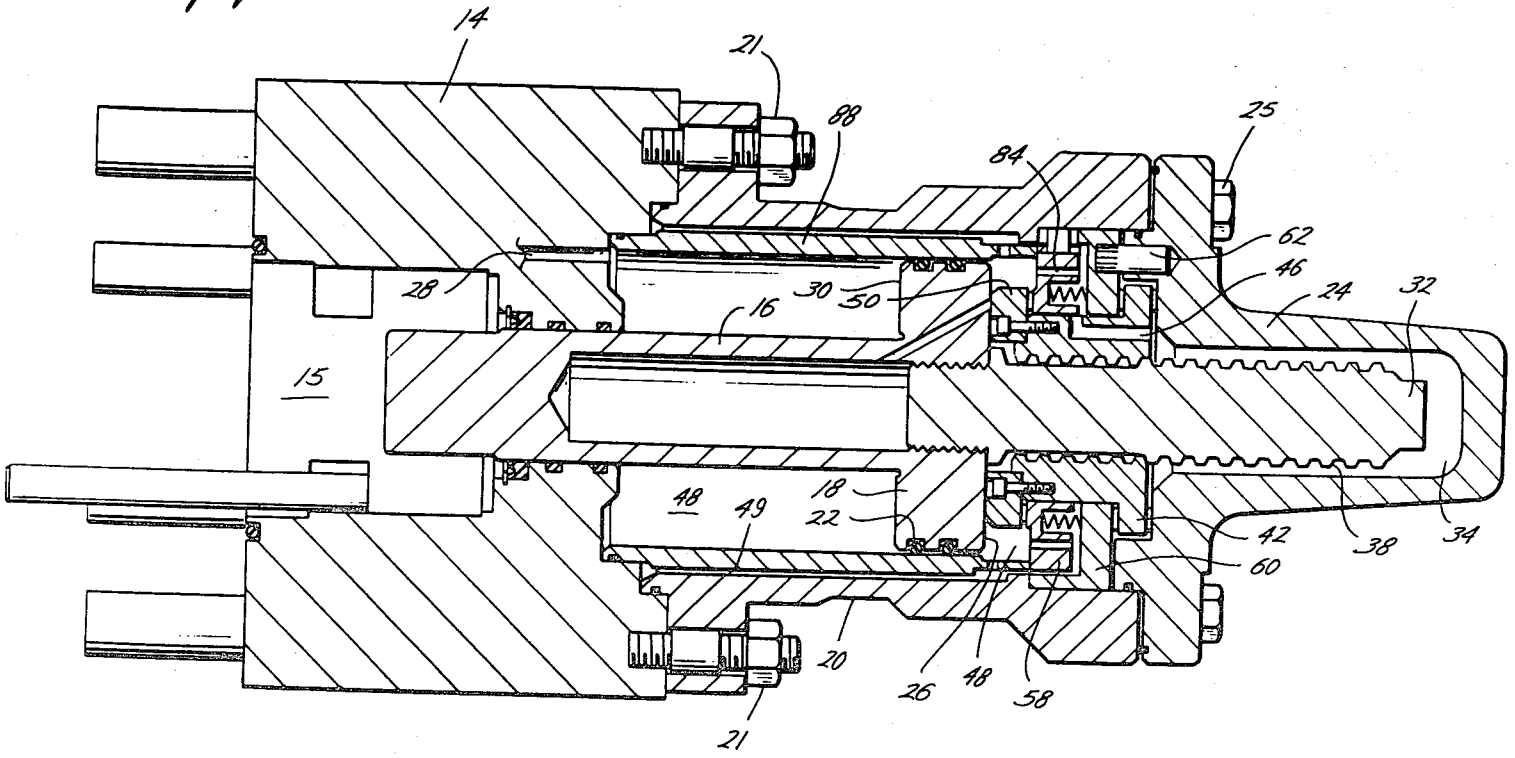
FIG. 2 is a vertical sectional view of a ram blowout preventer and lock of the present invention in an open position.

A conventional head or bonnet 14 (FIG. 2) is connected to each side of the body or housing 10 and each of such heads or bonnets has a conventional recess 15 aligned with the recesses in the housing or body 10 so that the rams R may be received in such recesses when they are in the retracted or open position (FIG. 1). A piston rod 16 (FIG. 2) extends through suitable sealing structure to the opening 15 of each head or bonnet 12. Each piston rod 16 extends to a piston or ram carrier 18 of conventional construction which is disposed in a ram piston cylinder 20 with O-rings 22 or other suitable seals therebetween. The piston 18 moves in response to the motive means M within the cylinder 20 in a manner to be set forth.

The ram piston cylinder 20 is mounted with the bonnet 14 by bolts 21 or other suitable fastening means. Similarly, a cylinder head cap or end closure 24 is mounted to the cylinder 20 by conventional bolts or other suitable fastening means.

Figure 3:
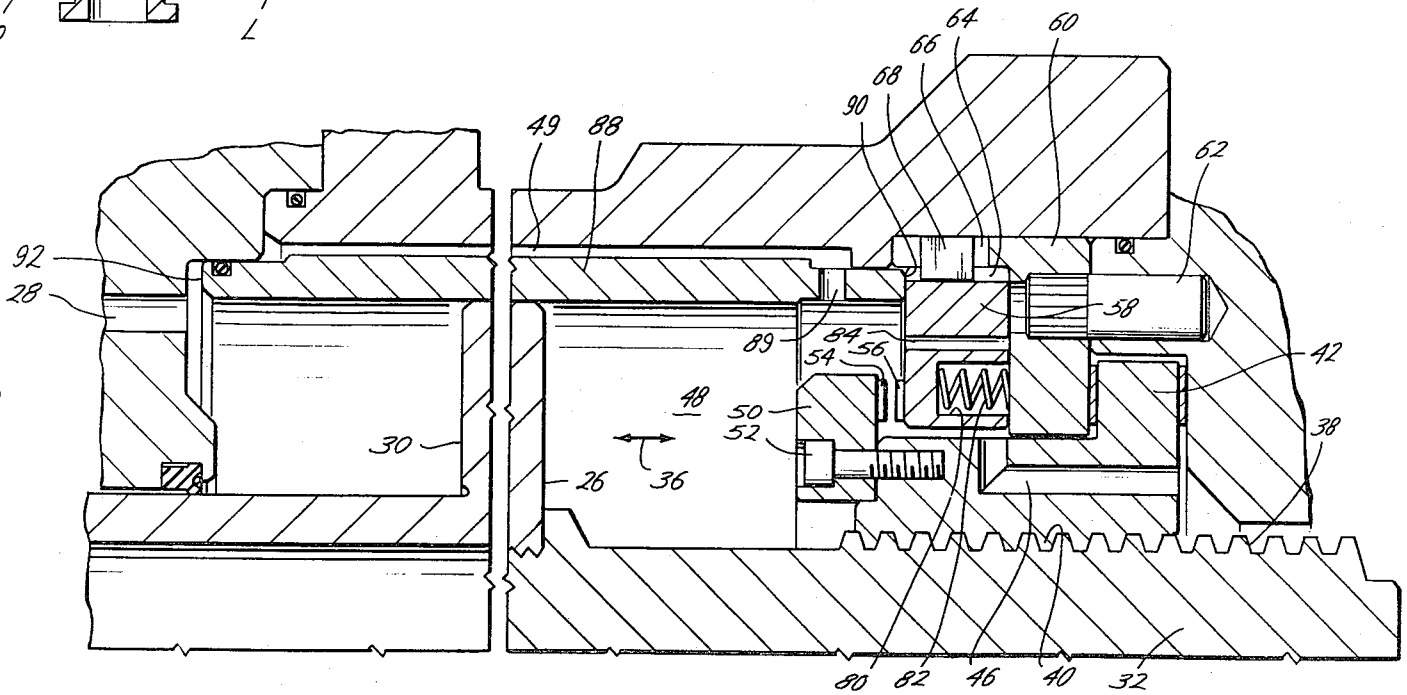
FIG. 3 is a vertical sectional view of the blowout preventer of FIG. 2 in a partially open position.

For purposes of illustration in the preferred embodiment, the motive means M includes a suitable fluid inlet line formed in the head cap 24 or elsewhere for introducing air, hydraulic fluid or other operating fluid pressure into the head cap 24 and cylinder 20 against an outer surface 26 of the piston 18 for moving the piston 18 inwardly (to the left as viewed in FIGS. 2 and 3) to move the rams R toward the center of the bore 12. An opening fluid conduit 28 is formed through the body of the bonnet 14 for introducing air, hydraulic fluid or other operating fluid pressure into the cylinder 20 against an inner surface 30 (FIG. 2) of the piston 18 for moving the piston 18 outwardly (to the right as viewed in FIGS. 2 and 3) to retract the ram R from the closed position in the bore 12.

It should be understood that various systems for providing operating or motive power to the blowout preventer B may be employed and the invention is not limited to the specific form illustrated in the drawings. It should also be understood that a similar power means is provided for the left-hand ram R as viewed at FIG. 1 in the same manner as the power means M illustrated for the right-hand ram R in FIG. 2.

Considering now the lock L, a piston tail shaft or rod 32 of the ram piston 18 extends rearwardly from the piston 18 and moves into and out of an opening 34 in the cylinder head 24, as the piston 18 (FIG. 3) moves transversely inwardly and outwardly (as indicated by an arrow 36) with respect to the bonnet 14 in response to the power means M. The piston tail rod 32 has a threaded external surface 38 formed thereon which is continuously engaged with a threaded inner surface 40 of a lock nut 42 of the lock L.

The threaded surfaces 38 and 40 are in the form of multistart helical threads which in response to fluid pressure convert transverse movement of the piston tail shaft 32 to rotational movement of the lock nut 42. An eight-start thread may be used, if desired, although it should be understood that helical threads having other numbers of start may be used as well.

The threaded surface 38 of the tail shaft 32 and threaded surface 40 of the lock nut 42 engage so that the lock nut 42 rotates in a clockwise direction (viewing the lock L from the direction of the ram R) as indicated by an arrow 44 in FIG. 4 in response to inward movement of the piston 18. As will be set forth below, the lock L restrains rearward movement of the piston 18 until unlocked, at which time the threaded surfaces 38 and 40 cause the lock nut 42 to move in a reverse or counterclockwise direction in response to outward movement of the piston 18. Suitable bearing surfaces are provided between the lock nut 42 and head cap 24 to reduce friction during relative movement therebetween.

It is to be noted that the piston 18 and tail shaft 32 do not rotate with respect to the cylinder 20 or bonnet 14 during inward or outward movement. Milled flats are formed near the end of shaft 32 to engage a slot in the ram carrier 18 to accomplish this function. When the lock L is disengaged, the lock nut 42 rotates with respect to the tail shaft 32 in the manner set forth above. When engaged, the lock L restrains rearward movement of the piston 18.

A fluid conduit 46 is formed in the lock nut 42 to provide fluid communication between the space or opening 48 to allow fluid to freely escape from the cylinder 20 as the rams R are being opened.

The lock L further includes a fixed or ram carrier clutch plate 50 mounted with the lock nut 42 by means of a bolt 52 other suitable connecting means so that the clutch plate 50 moves and rotates along with the lock nut 42 with respect to the tail shaft 32 during inward and outward movement of the ram R.

The ram carrier clutch plate 50 has ratchet teeth 54 (FIG. 4) formed on a rear surface thereof which are selectively engageable, in a manner to be set forth, with opposing ratchet teeth 56 of a movable or body clutch plate 58. The body clutch plate 58 is mounted within a cup member 60 which is mounted to the cylinder head 24 by pins 62 or other suitable mounting means. The cup member 60 may be integrally formed with the cylinder head 24, if desired. The body clutch plate 58 has several grooves 64 (FIG. 3) formed therein about its periphery adjacent corresponding grooves or slots 66 in cup member 60 so that a suitable number of keys 68 may be inserted to interconnect the cup member 60 and clutch plate 58 to prevent relative rotational movement therebetween while allowing relative longitudinal or transverse movement.

Each of the ratchet teeth 54 on the clutch plate 50 has a sloping ramp surface 70 (FIG. 4) formed thereon which contacts a conforming sloping ramp surface 72 of corresponding teeth 56 on the body clutch plate 58. Each of the ratchet teeth 54 and 56 further has a planar stop surface 74 and 76 respectively, formed between their adjacent ramp surfaces 70 and 72.

The ram carrier clutch plate 50 is mounted with the lock nut 42, as has been set forth, and the engaged sloping ramp surfaces 70 and 72 of the ratchet teeth permit the clutch plate 50 to move clockwise therewith, as indicated by the arrow 44 (FIG. 4) when the piston 18 is moving inwardly.

The body clutch plate 58 has a suitable number of sockets 80 formed therein facing the cup member 60 for receiving springs 82 or other suitable resilient means. The springs 82 move the body clutch plate 58 outwardly to a position where the ratchet teeth 54 and 56 are normally engaged (FIG. 4). A fluid port 84 is formed in the body clutch plate 58 to facilitate passage freely of fluid during opening of the rams R.

The locking mechanism L further includes a cylindrical sleeve or liner 88 mounted within the bonnet 14 and receiving the piston 18 therein for guiding the piston 18 during inward and outward movement. The liner 88 has a surface 90 formed on an outer surface which also responds to pressurized fluid applied against the surface 26 of the piston 18 and moves the liner 88 out of contact with the body clutch plate 58, permitting the springs 82 to move the ratchet teeth 54 and 56 into engagement.

During the inward movement of the piston 18, closing fluid pressure is admitted into head cap 24 against surface 26 of the piston 18. As has been set forth, this fluid pressure also acts on the cylinder liner 88 moving such liner out of contact with the clutch plate 58 to permit the spring 82 to urge the ratchet teeth 54 and 56 of the lock L into engagement. In this manner, the ram R is locked against rearward movement, which might be caused by forces such as well bore pressures and the like.

The ratchet teeth 54 and 56 are maintained in engagement by the force of the springs 82. In the locking position of lock L, the clutch plate 50 moves with the lock nut 42 during inward movement of the piston 18. The resilient springs 82, however, yield sufficiently to permit relative ratcheting movement between the ratchet teeth 54 of clutch plate 52 and the ratchet teeth 56 of the body clutch plate 58 as the piston 18 moves inwardly.

The cylinder liner 88 further has an inner annular surface 92 which responds to opening fluid pressure into the cylinder 20 by way of the opening fluid conduit 28 against the surface 30 of the piston 18. An O-ring or other suitable seal is mounted about an outer surface at an inner portion of the sleeve 88 to provide a seal between opening and closing pressure. A port 89 is formed in the sleeve 88 to permit fluid communication between the space 34, the space 48 and the annular space 49 between cylinder 20 and sleeve 88.

On receipt of such opening fluid pressure on the surface 92, the cylinder 88 moves rearwardly until the surface 90 thereof contacts the body clutch 58 and moves the clutch plate 58 rearwardly, overcoming the force exerted by the springs 82. In such a position (FIG. 3), the ratchet teeth 54 and 56 are out of contact with each other, and the locking mechanism L is unlocked. The threaded surface 38 of the tail shaft 32 is permitted to pass rearwardly through the surface of the lock nut 42, with the lock nut 42 and clutch plate 50 rotating in the reverse direction to the arrow 44 (FIG. 4).

It should be understood that a lock L is provided for the left-hand ram R as viewed in FIG. 1 in the same manner as the lock L discussed above for the right-hand ram R in FIG. 2.

In the operation of the blowout preventer B with the lock L, when it is desired to move the ram R inwardly from the open position (FIG. 1) to the closed position (FIG. 2), operating fluid pressure is provided through the fluid inlet in the cylinder head 24 to act on the ram piston 18 and move the ram R inwardly. The operating fluid 50 introduced also moves the cylinder liner 88 out of contact with the body clutch plate 58, permitting the ratchet teeth 54 and 56 of the locking mechanism L to engage in response to the springs 82. Engagement of the ratchet teeth 54 and 56 in the locking position occurs during initial stages of inward movement of the piston 18 from the open position.

With the ratchet teeth 54 of clutch plate 52 moved into the locking position (FIG. 4) with the ratchet teeth 54 of the clutch plate 56 from the outset of inward movement of the piston 18, contact is maintained between the ratchet ring teeth 54 and 56 by the springs 82. In this manner, during all stages of inward advance of the piston 18 with respect to the bore 12 of the preventer B, the lock nut 42 freely rides and rotates with respect to the piston tail shaft 32 permitting continuous inward advance of the ram R due to the relative movement of the sloped ratchet teeth 54 and 56 permitted by the springs 82.

However, at substantially all positions of the ram R with respect to the bore 12 during such inward movement, the ratchet teeth 54 and 56 are engaged and locked against any rearward force on the piston 18, locking so that the ram R is locked and restrained against such rearward movement. In this manner, the lock L automatically locks the ram piston 18 and the ram R against rearward movement at any position during inward movement thereof. It is to be noted that this automatic locking of the lock L occurs in response to the same fluid pressure which moves the piston 18 inwardly, since the lock L is continuously engaged with the piston 18, and thus without the need for a separate and distinct locking fluid control system from that of the moving fluid system.

Further, once the ram R has reached an initial sealing position contacting a well pipe or other object in the bore 12 of the preventer B, it is possible to compensate for wear of the blowout preventer sealing elements, typically elastomer or other sealing material. Once the initial closed position has been reached with the ram block forcing the ram sealing elements into an initial seal with the object in the bore 12, increased pressure is introduced to act on the ram piston 18 and move the piston 18 and ram R further inwardly. The ram R is moved further inwardly in this manner with the ram block forcing the sealing elements thereof into closer engagement with the object in the bore 12 increasing the feed of the sealing elements into contact with the object to compensate for any wear or loss of the sealing elements until the desired degree of sealing contact between the object in the bore and the ram R is obtained. It is to be noted that with the threaded contact between the tail shaft 32 of the piston 18 and the lock nut 42 the adjustable locking position obtained with the lock L may be selectively varied over a wide range of positions to achieve the desired seal in contrast to a limited number of fixed positions. The number and size of the discrete positions is dependent on the spacing of the ratchet teeth 54 and 56. It is further to be noted that automatic mechanical locking of the lock L is maintained during movement of the ram R to the adjustable closed position.

Once the ram R is in the desired sealing position, the pressure of the operating fluid may be abated and the ram R remains locked in the sealed position automatically by the lock L due to the locking engagement of the ratchet teeth 54 and 56, forming a locking connection betweeen the ram R and the remainder of the blowout preventer B.

When it becomes desirable or necessary to unlock the ram R from the adjustable closed position, suitable unlocking fluid pressure is provided through the opening fluid inlet 28. The fluid pressure through the inlet 28 acts on the inner surface 30 of the piston 18 to move such piston and the ram R rearwardly with respect to the blowout preventer B. Further, the fluid pressure concurrently acts on the surface 92 of liner 88 moving the liner into engagement with the body surface 92 clutch plate 58 and causing the ratchet teeth 54 and 56 to move out of engagement, unlocking the lock L in order to permit rearward movement of the piston 18.

The foregoing disclosure and description of the invention are illustrative and explanatory thereof and various changes in the size, shape and materials as well as in the details of the preferred embodiment may be made without departing from the spirit of the invention.

I claim:

1. In a blowout preventer having at least one blowout preventer ram movable therein to adjustable closed positions for sealing contact with a well pipe or the like in a bore of the blowout preventer, a ram lock comprising:

(a) ram carrier means comprising a ram piston having a piston rod with a threaded surface formed thereon for moving the ram to the adjustable closed positions in the blowout preventer;

(b) cylinder means for receiving opening and closing fluid pressures to operate against said ram piston to move the ram to and from open and closed positions, respectively;

(c) lock means for locking said ram carrier means at the closed positions, comprising:

(1) a lock nut having a threaded surface formed thereon and engaged by said threaded surface on said ram piston rod for rotational movement with respect thereto during movement of the ram;

(2) a ram carrier clutch plate mounted with said lock nut for rotational movement therewith, said ram carrier clutch plate having ratchet teeth formed thereon;

(3) a body clutch plate having ratchet teeth formed thereon; and (4) means for mounting said body clutch plate with the blowout preventer against relative rotational movement with respect thereto; and (d) means for urging said ratchet teeth of said body clutch plate and said ram carrier clutch plate into engagement to lock said ram carrier means; and (e) means for unlocking comprising cylinder liner means mounted in said cylinder and enclosing said piston of said ram carrier means;

(f) said cylinder liner means including surface means responding to the opening fluid pressure to engage said body clutch plate to disable said means for urging and unlock said ram lock.

2. The structure of claim 1, wherein said means for unlocking further comprises:

means responsive to the closing fluid pressure for enabling said means for urging.

3. The structure of claim 1, wherein said means for urging includes:

resilient means for moving said ratchet teeth into engagement.

4. The structure of claim 1, wherein:

said lock nut is engaged by said threaded surface on said ram piston rod for rotational movement with respect thereto during outward movement from the closed position.

5. The structure of claim 1, further including:

means for preventing relative rotational movement between said body clutch plate and said means for mounting.

6. The structure of claim 1, wherein said means for urging comprises:

means for moving said ratchet teeth of said body clutch plate and said ram carrier clutch plate into engagement to automatically lock said ram carrier means against outward movement as the ram is moving inwardly.

7. The structure of claim 1, wherein the preventer has at least a pair of rams, and wherein each of the rams has a ram lock for locking the ram at an adjustable closed position for sealing contact with a well pipe or the like in a bore of the blowout preventer, comprising:

(a) ram carrier means comprising a ram piston having a piston rod with a threaded surface formed thereon for moving the ram to the adjustable closed positions in the blowout preventer;

(b) cylinder means for receiving opening and closing fluid pressures to operate against said ram piston to move the ram to and from open and closed positions, respectively;

(c) lock means for locking said ram carrier means at the closed positions, comprising:

(1) a lock nut having a threaded surface formed thereon and engaged by said threaded surface on said ram piston rod for rotational movement with respect thereto during movement of the ram;

(2) a ram carrier clutch plate mounted with said lock nut for rotational movement therewith, said ram carrier clutch plate having ratchet teeth formed thereon;

(3) a body clutch plate having ratchet teeth formed thereon; and (4) means for mounting said body clutch plate with the blowout preventer against relative rotational movement with respect thereto; and (d) means for urging said ratchet teeth of said body clutch plate and said ram carrier clutch plate into engagement to lock said ram carrier means; and (e) means for unlocking comprising cylinder liner means mounted in said cylinder and enclosing said piston of said ram carrier means;

(f) said cylinder liner means including surface means responding to the opening fluid pressure to engage said body clutch plate to disable said means for urging and unlock said ram lock.

8. In a blowout preventer, a ram lock for automatically locking the ram against reverse or outward movement during inward movement to a closed position in response to closing fluid pressure for contact by the ram with a well pipe or the like in a bore of the preventer and for automatically unlocking in response to opening fluid pressure, comprising:

(a) ram carrier means comprising a ram piston having a piston rod with a threaded surface formed thereon for moving the ram to the adjustable closed positions in the blowout preventer;

(b) cylinder means for receiving opening and closing fluid pressures to operate against said ram piston to move the ram to and from open and closed positions, respectively;

(c) lock means for locking said ram carrier means at the closed positions, comprising:

(1) a lock nut having a threaded surface formed thereon and engaged by said threaded surface on said ram piston rod for rotational movement with respect thereto during movement of the ram;

(2) a ram carrier clutch plate mounted with said lock nut for rotational movement therewith, said ram carrier clutch plate having ratchet teeth formed thereon;

(3) a body clutch plate having ratchet teeth formed thereon; and (4) means for mounting said body clutch plate with the blowout preventer against relative rotational movement with respect thereto; and (d) means for urging said ratchet teeth of said body clutch plate and said ram carrier clutch plate into engagement to lock said ram carrier means; and (e) means for unlocking comprising cylinder liner means mounted in said cylinder and enclosing said piston of said ram carrier means;

(f) said cylinder liner means including surface means responding to the opening fluid pressure to engage said body clutch plate to disable said means for urging and unlock said ram lock.

9. The structure of claim 8, wherein said means for unlocking further comprises:

means responsive to the closing fluid pressure for enabling said means for urging.

10. The structure of claim 8, wherein said means for urging includes:

resilient means for moving said ratchet teeth into engagement.

11. The structure of claim 8, wherein:

said lock nut is engaged by said threaded surface on said ram piston rod for rotational movement with respect thereto during outward movement from the closed position.

12. The structure of claim 8, further including:

means for preventing relative rotational movement between said body clutch plate and said means for mounting.

13. The structure of claim 8, wherein said means for urging comprises:

means for moving said ratchet teeth of said body clutch plate and said ram carrier clutch plate into engagement to automatically lock said ram carrier means against outward movement as the ram is moving inwardly.

14. The structure of claim 8, wherein the preventer has at least a pair of rams, and wherein each of the rams has a ram lock for locking the ram at an adjustable closed position for sealing contact with a well pipe or the like in a bore of the blowout preventer, comprising:

(a) ram carrier means comprising a ram piston having a piston rod with a threaded surface formed thereon for moving the ram to the adjustable closed positions in the blowout preventer;

(b) cylinder means for receiving opening and closing fluid pressures to operate against said ram piston to move the ram to and from open and closed positions, respectively;

(c) lock means for locking said ram carrier means at the closed positions, comprising:

(1) a lock nut having a threaded surface formed thereon and engaged by said threaded surface on said ram piston rod for rotational movement with respect thereto during movement of the ram;

(2) a ram carrier clutch plate mounted with said lock nut for rotational movement therewith, said ram carrier clutch plate having ratchet teeth formed thereon;

(3) a body clutch plate having ratchet teeth formed thereon; and (4) means for mounting said body clutch plate with the blowout preventer against relative rotational movement with respect thereto; and (d) means for urging said ratchet teeth of said body clutch plate and said ram carrier clutch plate into engagement to lock said ram carrier means; and (e) means for unlocking comprising cylinder liner means mounted in said cylinder and enclosing said piston of said ram carrier means;

(f) said cylinder liner means including surface means responding to the opening fluid pressure to engage said body clutch plate to disable said means for urging and unlock said ram lock.

15. A ram lock for a blowout preventer ram for locking a ram for sealing contact with a well pipe or the like in the blowout preventer, comprising:

(a) ram carrier means comprising a ram piston having a piston rod with a threaded surface formed thereon for moving the ram to the adjustable closed positions in the blowout preventer;

(b) cylinder means for receiving opening and closing fluid pressures to operate against said ram piston to move the ram to and from open and closed positions, respectively;

(c) lock means for locking said ram carrier means at the closed positions, comprising:

(1) a lock nut having a threaded surface formed thereon and engaged by said threaded surface on said ram piston rod for rotational movement with respect thereto during movement of the ram;

(2) a ram carrier clutch plate mounted with said lock nut for rotational movement therewith, said ram carrier clutch plate having ratchet teeth formed thereon;

(3) a body clutch plate having ratchet teeth formed thereon; and (4) means for mounting said body clutch plate with the blowout preventer against relative rotational movement with respect thereto; and (d) means for urging said ratchet teeth of said body clutch plate and said ram carrier clutch plate into engagement to lock said ram carrier means; and (e) means for unlocking comprising cylinder liner means mounted in said cylinder and enclosing said piston of said ram carrier means;

(f) said cylinder liner means including surface means responding to the opening fluid pressure to engage said body clutch plate to disable said means for urging and unlock said ram lock.

16. The structure of claim 15, wherein said means for unlocking further comprises:

means responsive to the closing fluid pressure for enabling said means for urging.

17. The structure of claim 15, wherein said means for urging includes:

resilient means for moving said ratchet teeth into engagement.

18. The structure of claim 15, wherein:

said lock nut is engaged by said threaded surface on said ram piston rod for rotational movement with respect thereto during outward movement from the closed position.

19. The structure of claim 15, further including:

means for preventing relative rotational movement between said body clutch plate and said means for mounting.

20. The structure of claim 15, wherein said means for urging comprises:

means for moving said ratchet teeth of said body clutch plate and said ram carrier clutch plate into engagement to automatically lock said ram carrier means against outward movement as the ram is moving inwardly.

21. The structure of claim 15 wherein the preventer has at least a pair of rams, and wherein each of the rams has a ram lock for locking the ram at an adjustable closed position for sealing contact with a well pipe or the like in a bore of the blowout preventer, comprising:

(a) ram carrier means comprising a ram piston having a piston rod with a threaded surface formed thereon for moving the ram to the adjustable closed positions in the blowout preventer;

(b) cylinder means for receiving opening and closing fluid pressures to operate against said ram piston to move the ram to and from open and closed positions, respectively;

(c) lock means for locking said ram carrier means at the closed positions, comprising:

(1) a lock nut having a threaded surface formed thereon and engaged by said threaded surface on said ram piston rod for rotational movement with respect thereto during movement of the ram;

(2) a ram carrier clutch plate mounted with said lock nut for rotational movement therewith, said ram carrier clutch plate having ratchet teeth formed thereon;

(3) a body clutch plate having ratchet teeth formed thereon; and (4) means for mounting said body clutch plate with the blowout preventer against relative rotational movement with respect thereto; and (d) means for urging said ratchet teeth of said body clutch plate and said ram carrier clutch plate into engagement to lock said ram carrier means; and (e) means for unlocking comprising cylinder liner means mounted in said cylinder and enclosing said piston of said ram carrier means;

(f) said cylinder liner means including surface means responding to the opening fluid pressure to engage said body clutch plate to disable said means for urging and unlock said ram lock.

22. A ram lock for automatically locking the ram against reverse or outward movement during inward movement to a closed position in response to closing fluid pressure for contact by the ram with a well pipe or the like in a bore of the preventer and for automatically unlocking in response to opening fluid pressure, comprising:

(a) ram carrier means comprising a ram piston having a piston rod with a threaded surface formed thereon for moving the ram to the adjustable closed positions in the blowout preventer;

(b) cylinder means for receiving opening and closing fluid pressures to operate against said ram piston to move the ram to and from open and closed positions, respectively;

(c) lock means for locking said ram carrier means at the closed positions, comprising:

(1) a lock nut having a threaded surface formed thereon and engaged by said threaded surface on said ram piston rod for rotational movement with respect thereto during movement of the ram;

(2) a ram carrier clutch plate mounted with said lock nut for rotational movement therewith, said ram carrier clutch plate having ratchet teeth formed thereon;

(3) a body clutch plate having ratchet teeth formed thereon; and (4) means for mounting said body clutch plate with the blowout preventer against relative rotational movement with respect thereto; and (d) means for urging said ratchet teeth of said body clutch plate and said ram carrier clutch plate into engagement to lock said ram carrier means; and (e) means for unlocking comprising cylinder liner means mounted in said cylinder and enclosing said piston of said ram carrier means;

(f) said cylinder liner means including surface means responding to the opening fluid pressure to engage said body clutch plate to disable said means for urging and unlock said ram lock.

23. The structure of claim 22, wherein said means for unlocking further comprises:

means responsive to the closing fluid pressure for enabling said means for urging.

24. The structure of claim 22, wherein said means for urging includes:

resilient means for moving said ratchet teeth into engagement.

25. The structure of claim 22, wherein:

said lock nut is engaged by said threaded surface on said ram piston rod for rotational movement with respect thereto during outward movement from the closed position.

26. The structure of claim 22, further including:

means for preventing relative rotational movement between said body clutch plate and said means for mounting.

27. The structure of claim 22, wherein said means for urging comprises:

means for moving said ratchet teeth of said body clutch plate and said ram carrier clutch plate into engagement to automatically lock said ram carrier means against outward movement as the ram is moving inwardly.

28. The structure of claim 22 wherein the preventer has at least a pair of rams, and wherein each of the rams has a ram lock for locking the ram at an adjustable closed position for sealing contact with a well pipe or the like in a bore of the blowout preventer, comprising:

(a) ram carrier means comprising a ram piston having a piston rod with a threaded surface formed thereon for moving the ram to the adjustable closed positions in the blowout preventer;

(b) cylinder means for receiving opening and closing fluid pressures to operate against said ram piston to move the ram to and from open and closed positions, respectively;

(c) lock means for locking said ram carrier means at the closed positions, comprising:

(1) a lock nut having a threaded surface formed thereon and engaged by said threaded surface on said ram piston rod for rotational movement with respect thereto during movement of the ram;

(2) a ram carrier clutch plate mounted with said lock nut for rotational movement therewith, said ram carrier clutch plate having ratchet teeth formed thereon;

(3) a body clutch plate having ratchet teeth formed thereon; and (4) means for mounting said body clutch plate with the blowout preventer against relative rotational movement with respect thereto; and (d) means for urging said ratchet teeth of said body clutch plate and said ram carrier clutch plate into engagement to lock said ram carrier means; and (e) means for unlocking comprising cylinder liner means mounted in said cylinder and enclosing said piston of said ram carrier means;

(f) said cylinder liner means including surface means responding to the opening fluid pressure to engage said body clutch plate to disable said means for urging and unlock said ram lock.

* * * * *